US007824831B2

(12) United States Patent
Yamada et al.

(10) Patent No.: US 7,824,831 B2
(45) Date of Patent: Nov. 2, 2010

(54) TONER

(75) Inventors: Masahide Yamada, Numazu (JP); Akinori Saitoh, Numazu (JP); Osamu Uchinokura, Mishima (JP); Junichi Awamura, Numazu (JP)

(73) Assignee: Ricoh Company Limited, Tokyo (JP)

( * ) Notice: Subject to any disclaimer, the term of this patent is extended or adjusted under 35 U.S.C. 154(b) by 40 days.

(21) Appl. No.: 12/203,278

(22) Filed: Sep. 3, 2008

(65) Prior Publication Data

US 2009/0061345 A1 Mar. 5, 2009

(30) Foreign Application Priority Data

Sep. 3, 2007 (JP) ..... 2007-227332

(51) Int. Cl.
*G03G 9/12* (2006.01)

(52) U.S. Cl. ..... 430/108.1; 430/108.3; 430/109.4

(58) Field of Classification Search ..... 430/108.1, 430/108.3, 109.4
See application file for complete search history.

(56) References Cited

U.S. PATENT DOCUMENTS

| | | | | |
|---|---|---|---|---|
| 6,360,068 | B1 | 3/2002 | Kinoshita et al. | |
| 6,416,914 | B1 | 7/2002 | Nakamura et al. | |
| 6,432,589 | B1 | 8/2002 | Uchinokura et al. | |
| 6,432,590 | B1 | 8/2002 | Ueda et al. | |
| 6,479,204 | B1 | 11/2002 | Uchinokura et al. | |
| 6,503,676 | B2 | 1/2003 | Yamashita et al. | |
| 6,733,939 | B2 | 5/2004 | Nanya et al. | |
| 6,818,370 | B2 | 11/2004 | Uchinokura et al. | |
| 6,855,468 | B1 | 2/2005 | Yamamoto et al. | |
| 6,916,587 | B2 | 7/2005 | Fushimi et al. | |
| 7,083,890 | B2 | 8/2006 | Emoto et al. | |
| 7,129,013 | B2 | 10/2006 | Higuchi et al. | |
| 7,163,773 | B2 * | 1/2007 | Sugiura et al. | 430/109.4 |
| 7,258,959 | B2 | 8/2007 | Nakayama et al. | |
| 7,300,736 | B2 | 11/2007 | Fushimi et al. | |
| 7,318,989 | B2 | 1/2008 | Kotsugai et al. | |
| 7,348,117 | B2 | 3/2008 | Inoue et al. | |
| 7,348,121 | B2 | 3/2008 | Inoue et al. | |
| 7,368,213 | B2 | 5/2008 | Nakayama et al. | |
| 7,374,848 | B2 | 5/2008 | Matsuoka et al. | |
| 7,374,851 | B2 | 5/2008 | Nakayama et al. | |
| 2004/0229147 | A1 | 11/2004 | Higuchi et al. | |
| 2005/0089786 | A1 | 4/2005 | Sugiura et al. | |
| 2005/0089787 | A1 | 4/2005 | Uchinokura et al. | |
| 2005/0112488 | A1 | 5/2005 | Yamada et al. | |
| 2005/0164112 | A1 | 7/2005 | Ohki et al. | |
| 2005/0180786 | A1 | 8/2005 | Yamada et al. | |
| 2005/0186498 | A1 | 8/2005 | Honda et al. | |
| 2005/0208408 | A1 | 9/2005 | Uchinokura et al. | |
| 2006/0024097 | A1 | 2/2006 | Yamada et al. | |
| 2006/0029433 | A1 | 2/2006 | Saito et al. | |
| 2006/0046174 | A1 | 3/2006 | Ohki et al. | |
| 2006/0057488 | A1 | 3/2006 | Inoue et al. | |
| 2006/0063081 | A1 | 3/2006 | Nagatomo et al. | |
| 2006/0063089 | A1 | 3/2006 | Tanaka et al. | |
| 2006/0068312 | A1 | 3/2006 | Yamashita et al. | |
| 2006/0099529 | A1 | 5/2006 | Tanaka et al. | |
| 2006/0160011 | A1 | 7/2006 | Inoue et al. | |
| 2006/0177755 | A1 * | 8/2006 | Toizumi et al. | 430/108.8 |
| 2006/0210903 | A1 | 9/2006 | Ohki et al. | |
| 2006/0251979 | A1 | 11/2006 | Watanabe et al. | |
| 2007/0054210 | A1 | 3/2007 | Ohki et al. | |
| 2007/0059626 | A1 | 3/2007 | Inoue et al. | |
| 2007/0082285 | A1 * | 4/2007 | Matsuoka et al. | 430/109.3 |
| 2007/0134581 | A1 | 6/2007 | Uchinokura et al. | |
| 2007/0141500 | A1 * | 6/2007 | Sugimoto et al. | 430/110.3 |
| 2007/0218380 | A1 | 9/2007 | Uchinokura et al. | |
| 2007/0218381 | A1 | 9/2007 | Uchinokura et al. | |
| 2007/0218382 | A1 | 9/2007 | Emoto et al. | |
| 2007/0218389 | A1 | 9/2007 | Honda et al. | |
| 2007/0218391 | A1 | 9/2007 | Yamada et al. | |
| 2007/0218392 | A1 | 9/2007 | Yamada et al. | |
| 2007/0264035 | A1 | 11/2007 | Fushimi et al. | |
| 2008/0014527 | A1 | 1/2008 | Kotsugai et al. | |
| 2008/0069616 | A1 | 3/2008 | Kojima et al. | |
| 2008/0070144 | A1 | 3/2008 | Nagatomo et al. | |
| 2008/0070148 | A1 | 3/2008 | Awamura et al. | |
| 2008/0076055 | A1 | 3/2008 | Sawada et al. | |
| 2008/0090165 | A1 | 4/2008 | Yamada et al. | |

FOREIGN PATENT DOCUMENTS

| | | |
|---|---|---|
| JP | 60-90344 | 5/1985 |
| JP | 62-63940 | 3/1987 |
| JP | 64-15755 | 1/1989 |
| JP | 2-82267 | 3/1990 |
| JP | 3-41470 | 2/1991 |
| JP | 3-229264 | 10/1991 |
| JP | 9-34167 | 2/1997 |

(Continued)

OTHER PUBLICATIONS

U.S. Appl. No. 12/026,937, filed Feb. 6, 2008, Seshita, et al.
U.S. Appl. No. 12/091,301, filed Apr. 24, 2008, Sugiura, et al.
U.S. Appl. No. 12/046,011, filed Mar. 11, 2008, Nagatomo, et al.
U.S. Appl. No. 12/042,041, filed Mar. 4, 2008, Yamada, et al.
U.S. Appl. No. 12/112,601, filed Apr. 30, 2008, Sabu, et al.
U.S. Appl. No. 12/118,006, filed May 9, 2008, Nakayama, et al.
U.S. Appl. No. 12/059,199, filed Mar. 31, 2008, Nakayama, et al.
U.S. Appl. No. 12/282,075, filed Sep. 8, 2008, Watanabe, et al.

*Primary Examiner*—Hoa V Le
(74) *Attorney, Agent, or Firm*—Oblon, Spivak, McClelland, Maier & Neustadt, L.L.P.

(57) ABSTRACT

A toner including a binder resin, a colorant, and a release agent is provided. The difference in absorbance ratio between the toner heated for 1 minute in an atmosphere of 100° C. and the toner stored in an atmosphere of 23° C. is from 0.1 to 0.2. The absorbance ratio is a ratio of an absorbance specific to the release agent (such as at 2850 $cm^{-1}$ for a wax) to an absorbance specific to the binder resin (such as at 828 $cm^{-1}$ for a polyester based binder resin), as measured by a Fourier transform infrared-total reflectance (FTIR-ATR) method.

13 Claims, No Drawings

FOREIGN PATENT DOCUMENTS

| | | |
|---|---|---|
| JP | 11-149180 | 6/1999 |
| JP | 11-305486 | 11/1999 |
| JP | 2005-301261 | 10/2005 |
| JP | 2006-30981 | 2/2006 |
| JP | 2006-243510 | 9/2006 |
| JP | 2006-258901 | 9/2006 |
| JP | 2007-72333 | 3/2007 |
| JP | 2007-79196 | 3/2007 |
| JP | 2007-249082 | 9/2007 |

* cited by examiner

TONER

BACKGROUND OF THE INVENTION

1. Field of the Invention

The present invention relates to a toner for developing an electrostatic image in electrophotography, electrostatic recording, electrostatic printing, and the like. Specifically, the present invention relates to a toner for use in electrophotographic apparatuses such as copiers, laser printers, and facsimiles.

2. Discussion of the Background

In a typical electrophotographic image forming process, an electrostatic latent image is formed on a photoreceptor containing a photoconductive material and developed with a developer to form a visible image. The visible image is transferred onto a recording medium such as paper, and fixed thereon by application of heat, pressure, solvent vapor, and the like.

Methods for developing an electrostatic latent image are broadly classified into liquid developing methods using a liquid developer in which a pigment or a dye is finely dispersed in an insulative organic liquid, and dry developing methods, such as a cascade method, a magnetic brush method, or a powder cloud method, using a dry developer (hereinafter "toner") in which a colorant, such as carbon black, is dispersed in a resin. The dry developing methods are becoming widely used recently.

On the other hand, as a method for fixing an image formed with a dry developer, i.e., a toner image, on a recording medium, a heat roller method is widely used from the viewpoint of energy efficiency. In recent attempts to reduce energy consumption in fixing, toners are required to be fixable at low temperatures. In other words, a smaller amount of energy is required when a toner image is fixed on a recording medium. The International Energy Agency (IEA) Demand-Side Management (DSM) program in 1999 involves a technology procurement project for next-generation copiers, and a requested specification is disclosed therein. Specifically, copiers with a printing speed of 30 cpm or more are required to have a warm-up time of 10 seconds or less and to consume energy in an amount of from 10 to 30 watts in the warm-up, which is a drastic energy-saving requirement compared to conventional copiers. To respond to the requirement, one possible approach involves reducing heat capacity of a fixing member such as a heat roller, so that temperature response of a toner is improved. However, this approach is insufficient to respond to the requirement.

To minimize the warm-up time, it is necessary that toners are fixable at low temperatures. To respond to such a requirement, toners using polyester resins, which are fixable at lower temperatures and have better thermostable preservability than conventionally-used styrene-acrylic resins, are disclosed in Unexamined Japanese Patent Applications Publications Nos. (hereinafter "JP-A") 60-90344, 64-15755, 02-82267, 03-229264, 03-41470, and 11-305486. On the other hand, JP-A 62-63940 discloses a toner including a binder resin including a non-polyolefin crystalline polymer so as to improve fixing ability at low temperatures (hereinafter "low-temperature fixability"), and Japanese Patent No. (hereinafter "JP") 2931899 discloses a toner including a crystalline polyester. However, the molecular structure and molecular weight of these crystalline polymers are not optimized therein.

None of the above-described toners satisfy the required specification of the DSM program. Therefore, a technology for further improving low-temperature fixability is needed. One possible approach involves controlling thermal properties of a binder resin, such as reducing the glass transition temperature (Tg) and/or molecular weight thereof. However, too much reduction of the glass transition temperature causes deterioration of thermostable preservability. In addition, too much reduction of the molecular weight decreases the softening point, and thereby decreasing a minimum temperature at which hot offset occurs. The "hot offset" here refers to an undesirable phenomenon in that part of a fused toner image is adhered to the surface of a heat member, and re-transferred onto an undesired portion of a recording medium. Consequently, a desired toner cannot be obtained only by controlling thermal properties of binder resins.

Methods for manufacturing toner are broadly classified into pulverization methods and polymerization methods.

In a pulverization method, a thermoplastic resin, a colorant, a charge controlling agent, an offset inhibitor, and the like, are evenly melt-mixed, and the mixture is then subjected to pulverization and classification. The pulverization method is capable of manufacturing a toner having a certain level of desired properties. However, there is a drawback that materials usable for the pulverization method are limited. For example, the toner composition is required to be treatable by an economical pulverization and classification apparatus. Therefore, the toner composition needs to be brittle. However, a brittle toner composition tends to produce particles with a broad particle diameter distribution by pulverization. To produce a copy image having good resolution and gradation, fine particles having a particle diameter of 4 μm or less and coarse particles having a particle diameter of 15 μm or more need to be removed, resulting in low yield. Further, it is difficult to evenly disperse a colorant, a charge controlling agent, and the like agent, in a thermoplastic resin by the pulverization method. Therefore, fluidity, developability, and durability of the resultant toner and image quality of the resultant image may deteriorate.

In attempting to solve the above-described problems of the pulverization method, polymerization methods have been proposed. For example, suspension polymerization methods and emulsion aggregation methods, such as the method disclosed in JP 2537503, are known. However, toners including a polyester resin, which may have good fixing ability at low temperatures, are difficult to manufacture by the polymerization methods.

In attempting to use polyester resins for non-pulverization methods, JP-A09-34167 discloses one possible method for manufacturing toner. In this method, first, toner compositions including a polyester resin are pulverized into particles, and the particles are then dispersed in an aqueous medium and treated with a solvent, so that spherical toner particles are formed. As another approach, JP-A 11-149180 discloses a method for manufacturing toner using an isocyanate reaction in an aqueous medium. However, neither of these toners have sufficient low-temperature fixability and productivity.

SUMMARY OF THE INVENTION

Accordingly, an object of the present invention is to provide a toner having a good combination of low-temperature fixability and hot offset resistance while producing high-definition images.

These and other objects of the present invention, either individually or in combinations thereof, as hereinafter will become more readily apparent can be attained by a toner, comprising:

a binder resin;

a colorant; and a release agent, wherein a difference in absorbance ratio between the toner heated for 1 minute in an atmosphere of 100° C. and the toner stored in an atmosphere of 23° C. is from 0.1 to 0.2, the absorbance ratio is a ratio of an absorbance specific to the release agent (such as at2850 $cm^{-1}$ for a wax) to an absorbance specific to the binder resin (such as at 828 $cm^{-1}$ for a polyester based binder resin), as measured by a Fourier transform infrared-total reflectance (FTIR-ATR) method.

DETAILED DESCRIPTION OF THE INVENTION

Generally, the present invention provides a toner comprising a binder resin, a colorant, and a release agent, in which a difference in absorbance ratio between the toner heated for 1 minute in an atmosphere of 100° C. and the toner stored in an atmosphere of 23° C. is from 0.1 to 0.2. Here, the absorbance ratio is a ratio of an absorbance specific to the release agent (such as at 2850 $cm^{-1}$ for a wax) to an absorbance specific to the binder resin (such as at 828 $cm^{-1}$ for a polyester based binder resin), as measured by a Fourier transform infrared-total reflectance (FTIR-ATR) method. Within the context of the present invention, the phrase "absorbance specific to" either the release agent or the binder resin indicates that the absorbance at a particular wave number is found in the release agent but not in the binder resin, or found in the binder resin but not in the release agent, respectively. Such a toner of the present invention satisfies both low-temperature fixability and hot offset resistance and provides high definition images.

A toner including a release agent, such as a wax, is generally used to improve separability of the toner from a fixing member such as a heat roller. However, such a toner has a drawback that the release agent tends to adhere to other components such as a photoreceptor in long-term printing, resulting in deterioration of the resultant image quality. Therefore, the toner is required not to contaminate other components with the release agent while having good separability from the fixing member.

When the amount of release agent in a toner is reduced, the release agent is prevented from adhering to other components, but the toner may not express sufficient releasability. Alternatively, when the dispersion diameter of a release agent in a toner is reduced, the same phenomena may occur.

Accordingly, a toner is required to include a sufficient amount of a release agent with a proper dispersion diameter, so that the release agent exposes at the surface of the toner without contaminating other components such as a photoreceptor. Such a toner has good separability and the release agent in the toner does not adhere to other components.

The amount of a release agent existing at the surface of a toner particle can be measured by a Fourier transform infrared-total reflectance (FTIR-ATR) method. Specifically, the FTIR-ATR method measures the amount of a release agent existing in a region extending from the surface of a toner particle to a depth of 0.3 μm in principle.

In the present invention, "absorbance ratio" is defined as a ratio of an absorbance specific to a release agent to an absorbance specific to a binder resin measured by the FTIR-ATR method. When the difference in absorbance ratio between a toner heated for 1 minute in an atmosphere of 100° C. and that of the toner stored in an atmosphere of 23° C. is 0.1 to 0.2, the toner expresses good releasability while preventing the release agent from adhering to other components.

The absorbance ratio of a toner stored in an atmosphere of 23° C. is preferably from 0.03 to 0.2.

A reason why the heating temperature is 100° C. is as follows. When the heating temperature is higher than 100° C., for example, 130° C., the toner softens too much, and therefore the measurement may not be reliably performed.

Procedures for the measurement of the absorbance will be described in detail below.

First, 3 g of a sample is formed into a pellet having a diameter of 40 mm and a thickness of about 2 mm using an automatic pelletizer (preferably TYPE M No. 50 BRP-E from Maekawa Testing Machine Mfg Co., Ltd.) by being compressed for 1 minute with a load of 6 t. The pellet is stored in an atmosphere of 23° C., and the surface thereof is subjected to a measurement by the FTIR-ATR method. Subsequently, the pellet is heated for 1 minute in an atmosphere of 100° C., and thereafter the surface thereof is subjected to a measurement by the FTIR-ATR method again. A microscopic FTIR apparatus SPECTRUM ONE (from Perkin Elmer Japan Co., Ltd.) equipped with a MULTISCOPE FTIR unit is preferably used for the measurement. More preferably, a micro ATR unit including a crystal of germanium (Ge) having a diameter of 100 μm is used for the measurement. Preferably, the angle of incidence of infrared ray is 41.5°, the resolving power is 4 $cm^{-1}$, and the number of accumulation is 20.

The absorbance ratio, which is a ratio of an absorbance specific to a release agent to an absorbance specific to a binder resin measured by the FTIR-ATR method, represents a relative amount of the release agent existing at the surface of a toner particle. The measurement is repeated for 4 times by changing measurement positions, and the measured values are calculated.

To heat the pellet to 100° C. for 1 minute, an apparatus INFRARED MOISTURE DETERMINATION BALANCE FD600 (from Kett Electric Laboratory) is preferably used. After the real temperature of the apparatus becomes 100° C., the pellet is placed on a saucer and covered with a lid, and allowed to stand for 1 minute. The saucer on which the pellet is placed is taken out of the apparatus and allowed to stand to cool at room temperature. A surface of the pellet which has been in contact with a heater of the apparatus is subjected to the measurement by the FTIR-ATR method.

The above-described toner, in which the difference in absorbance ratio between the toner heated for 1 minute in an atmosphere of 100° C. and that of the toner stored in an atmosphere of 23° C. is 0.1 to 0.2, is preferably obtainable by an aqueous granulation method.

In an aqueous granulation method, such as a method in which primary particles of toner constituents or a toner constituent mixture liquid are/is dispersed in an aqueous medium, dispersion and distribution states of the toner constituents in the resultant toner largely depend on polarities of the aqueous medium and the toner constituents, or the kind of solvents and monomers which may be included in the toner constituent mixture liquid.

For example, are lease agent typically has a lower polarity than a binder rein. Generally, a material having a similar polarity to the aqueous medium tend to localize in a surface area of the resultant toner particle, although the kind of solvents and monomers included in the toner constituent mixture liquid may have an influence on dispersion state. Accordingly, when the binder resin has a higher polarity and the release agent has a lower polarity, the release agent tends to localize in a center part of the resultant toner particle, or to be encapsulated by the binder resin.

By considering properties (e.g., polarity, effects of substituents) of binder resins and release agents, the toner of the present invention including a release agent with a specific dispersion state can be obtained.

The polarity of a binder resin largely depends on acid value and hydroxyl value. Therefore, the compatibility of the binder resin with the aqueous medium or the release agent depends on the acid value and hydroxyl value thereof.

As described above, a release agent typically has a lower polarity than a binder resin. Therefore, the release agent may be properly dispersed in the binder resin not only by considering polarities, but also by using a release agent disperser, which improves dispersibility and compatibility of a release agent in/with a binder resin. In other words, the release agent disperser can control the dispersibility of the release agent in the binder resin. By properly controlling the kind and amount of the release agent disperser, the release agent can be encapsulated by the binder resin. Such a configuration reduces the amount of the release agent exposed at the surface of the toner, so that the release agent present inside the toner may exude out from the surface thereof when heated.

Possible methods for accelerating the encapsulation of the release agent include, but are not limited to, increasing the amount of the release agent disperser, increasing the acid value of the binder resin, and decreasing the polarity of the release agent.

Dispersibility and compatibility of a release agent in/with a binder resin also depend on dispersion diameter of the release agent. When the dispersion diameter of the release agent is large, the amount of the release agent exposed at the surface of the toner may be increased, resulting in large localization of the release agent.

The above-described toner may be easily obtained by an emulsion aggregation method, in which primary particles of toner constituents are aggregated to form toner particles, especially when the aggregation is performed in multiple steps. Specifically, the outermost layer may be formed so as to include a less amount of primary particles of a release agent, or primary particles of a release agent may be covered with a binder resin before being aggregated.

The toner of the present invention is preferably obtained by a method including:

dissolving or dispersing a binder resin optionally together with a precursor of a binder resin, a colorant, and a release agent, in an organic solvent to prepare a toner constituent liquid;

dispersing the toner constituent liquid in an aqueous medium to prepare an emulsion containing the toner.

The toner constituent liquid includes toner constituents such as the binder resin and/or the precursor of a binder resin, the colorant, and the release agent, which are dissolved or dispersed in the organic solvent. The organic solvent is preferably removed at a time or after the resultant toner particles are formed.

As the organic solvent, any solvents capable of dissolving or dispersing the toner constituents can be used. Preferably, the organic solvent has a boiling point less than 150° C. in order to be more easily removable.

Specific examples of usable organic solvent include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Among these organic solvents, toluene, xylene, benzene, methylene chloride, 1,2-dichloroethane, chloroform, and carbon tetrachloride are preferably used, and ethyl acetate is more preferably used. These organic solvents can be used alone or in combination.

The amount of the organic solvent is typically from 40 to 300 parts by weight, preferably from 60 to 140 parts by weight, and more preferably from 80 to 120 parts by weight, per 100 parts by weight of solid components of the toner constituents.

As the binder resin, polyester resins are preferably used. Polyester resins typically have an absorbance at 828 $cm^{-1}$ measured by the FTIR-ATR method. In a preferred embodiment of the present invention, the release agent does not have an absorbance at this wave number, and the absorbance ratio uses the absorbance at 828 $cm^{-1}$ as representing the absorbance specific to the binder resin.

As the precursor of a binder resin, a polyester prepolymer (A) having an isocyanate group can be used. Specific examples of the polyester prepolymer (A) having an isocyanate group include a reaction product of a polyester having an active hydrogen group, which is a polycondensation product of a polyol (1) with a polycarboxylic acid (2), with a polyisocyanate (3) or an aliphatic polyol, but are not limited thereto. Specific examples of the active hydrogen group included in the polyester include, but are not limited to, hydroxyl groups (e.g., alcoholic hydroxyl group, phenolic hydroxyl group), amino group, carboxyl group, and mercapto group. Among these groups, alcoholic hydroxyl group is preferable.

As the polyol (1), diols and polyols having 3 or more valences can be used. Specifically, a diol alone, and a mixture of a diol with a small amount of a triol are preferably used.

Specific examples of usable diols include, but are not limited to, alkylene glycols (e.g., ethylene glycol, 1,2-propylene glycol, 1,3-propylene glycol, 1,4-butanediol, 1,6-hexanediol), alkylene ether glycols (e.g., diethylene glycol, triethylene glycol, dipropylene glycol, polyethylene glycol, polypropylene glycol, polytetramethylene ether glycol), alicyclic diols (e.g., 1,4-cyclohexanedimethanol, hydrogenated bisphenol A), bisphenols (e.g., bisphenol A, bisphenol F, bisphenol S), alkylene oxide (e.g., ethylene oxide, propylene oxide, butylene oxide) adducts of the above-described alicyclic diols, andalkyleneoxide (e.g., ethyleneoxide, propyleneoxide, butylene oxide) adducts of the above-described bisphenols. Among these compounds, alkylene glycols having 2 to 12 carbon atoms and alkylene oxide adducts of bisphenols are preferably used, and combinations of alkylene oxide adducts of bisphenols with alkylene glycols having 2 to 12 carbon atoms are more preferably used.

Specific examples of usable polyols having 3 or more valences include, but are not limited to, polyvalent aliphatic alcohols having 3 or more valences (e.g., glycerin, trimethylolethane, trimethylolpropane, pentaerythritol, sorbitol), phenols having 3 or more valences (e.g., trisphenol PA, phenol novolac, cresol novolac), and alkylene oxide adducts of polyphenols having 3 or more valences.

These polyols can be used alone or in combination.

As the polycarboxylic acid (2), dicarboxylic acids and polycarboxylic acids having 3 or more valences can be used. Specifically, a dicarboxylic acid alone, and a mixture of a dicarboxylic acid with a small amount of a polycarboxylic acid having 3 or more valences are preferably used.

Specific examples of usable dicarboxylic acids include, but are not limited to, alkylene dicarboxylic acids (e.g., succinic acid, adipic acid, sebacic acid), alkenylene dicarboxylic acids (e.g., maleic acid, fumaric acid), and aromatic dicarboxylic acids (e.g., phthalic acid, isophthalic acid, terephthalic acid, naphthalenedicarboxylic acid). Among these compounds, alkenylene dicarboxylic acids having 4 to 20 carbon atoms and aromatic dicarboxylic acids having 8 to 20 carbon atoms are preferably used.

Specific examples of usable polycarboxylic acids having 3 or more valences include, but are not limited to, aromatic polycarboxylic acids having 9 to 20 carbon atoms (e.g., trimellitic acid, pyromellitic acid).

Further, acid anhydrides and lower alkyl esters (e.g., methyl ester, ethyl ester, isopropyl ester) of the above-described compounds may be reacted with the polyols (1), to prepare the polycarboxylic acid (2).

These polycarboxylic acids can be used alone or in combination.

The equivalent ratio ([OH]/[COOH]) of hydroxyl group [OH] of the polyol (1) to carboxyl group [COOH] of the polycarboxylic acid (2) is typically from 2/1 to 1/1, preferably from 1.5/1 to 1/1, and more preferably from 1.3/1 to 1.02/1. The resultant polyester resin preferably has a hydroxyl value of from 14 to 19 mgKOH/g.

Specific examples of usable polyisocyanates (3) include, but are not limited to, aliphatic polyisocyanates (e.g., tetramethylene diisocyanate, hexamethylene diisocyanate, 2,6-diisocyanatomethylcaproate), alicyclic polyisocyanates (e.g., isophorone diisocyanate, cyclohexylmethane diisocyanate), aromatic diisocyanates (e.g., tolylene diisocyanate, diphenylmethane diisocyanate), aromatic aliphatic diisocyanates (e.g., α,α,α',α'-tetramethylxylylene diisocyanate), isocyanurates, and the above-described polyisocyanates blocked with phenol derivatives, oxime, caprolactam, etc. These compounds can be used alone or in combination.

Specific examples of usable aliphatic polyols include, but are not limited to, trimethylolpropane and pentaerythritol. A mixture of the polyester resin and the aliphatic polyol preferably has a hydroxyl value of from 10 to 20 mgKOH/g, and more preferably from 12 to 18 mgKOH/g. When the hydroxyl value is too small, the resultant prepolymer may have poor temporal stability. When the hydroxyl value is too large, low-temperature fixability of the resultant toner may deteriorate.

The equivalent ratio ([NCO]/[OH]) of isocyanate group [NCO] in the polyisocyanate (3) to hydroxyl group [OH] in the polyester is typically from 4/1 to 2/1, and preferably from 2.5/1 to 2.1/1.

The toner constituents may include a layered inorganic mineral in which interlayer ions are partially modified with an organic ion, and any materials other than the binder resin and/or the precursor of a binder resin, the colorant, and the release agent, if desired. The binder resin and/or the precursor of a binder resin may include any one of a monomer, a polymer, a compound having an active hydrogen group, and a polymer having reactivity with an active hydrogen group.

The layered inorganic mineral here refers to an inorganic mineral in which layers having a thickness of several nanometers are overlaid on one another. In the layered inorganic mineral for use in the present invention, interlayer ions are partially modified with an organic ion. In other words, an organic ion is introduced between the layers. Such an introduction of an organic ion is broadly interpreted as intercalation.

As the layered inorganic minerals, smectite group minerals (e.g., montmorillonite, saponite), kaolin group minerals (e.g., kaolinite), magadiite, kanemite, etc., are known. The layered inorganic minerals typically have high hydrophilicity. Therefore, if a layered inorganic mineral not modified with any organic ion is included in the toner constituent liquid, such a layered inorganic mineral may migrate to the aqueous medium when granulating toner particles. As a result, the resultant toner particles may not be deformed. By contrast, a layered inorganic mineral in which interlayer ions are modified with an organic ion (hereinafter "modified layered inorganic mineral") has a proper hydrophobicity, and therefore such a modified layered inorganic mineral may localize at the surfaces of the resultant toner particles. Accordingly, the resultant toner particles may be deformed to have an irregular shape, and have good charge control ability. The toner constituents preferably include the modified layered inorganic mineral in an amount of from 0.05 to 5.0% by weight.

The modified layered inorganic mineral for use in the present invention preferably has a basic crystal structure of smectite and is modified with an organic cation.

Specific examples of usable organic cationic modifying agents for partially modifying interlayer ions of a layered inorganic mineral include, but are not limited to, quaternary alkyl ammonium salts, phosphonium salts, and imidazolium salts. Among these organic cationic modifying agents, quaternary alkyl ammonium salts are preferably used. Specific examples of the quaternary alkyl ammonium include, but are not limited to, trimethyl stearyl ammonium, dimethyl stearyl benzyl ammonium, dimethyl octyl decyl ammonium, and oleyl bis(2-hydroxyethyl)methyl ammonium.

Specific examples of usable organic anionic modifying agents include, but are not limited to, sulfates, sulfonates, carboxylates, and phosphates each having an unbranched or cyclic alkyl (C1-C44), an alkenyl (C1-C22), an alkoxy (C8-C32), a hydroxyalkyl (C2-C22), ethylene oxide, propylene oxide, and the like. Among these organic anionic modifying agents, a carboxylate having an ethylene oxide is preferably used.

By partially modifying interlayer ions of a layered inorganic mineral with an organic ion, the modified layered inorganic mineral may have a proper hydrophobicity, and therefore the toner constituent liquid may have a non-Newtonian viscosity. Accordingly, the resultant toner may have an irregular shape. The toner constituent liquid preferably includes the modified layered inorganic mineral in an amount of from 0.05 to 5% by weight, and more preferably from 0.05 to 2% by weight.

Specific examples of usable modified layered inorganic minerals include, but are not limited to, montmorillonite, bentonite, hectorite, attapulgite, sepiolite, and mixtures thereof, which are partially modified with an organic ion. Among these, montmorillonite and bentonite are preferably used because viscosity of the toner constituent liquid is easily controllable with a small amount while not adversely affecting toner properties.

Specific examples of commercially available modified layered inorganic minerals which are partially modified with an organic cation include, but are not limited to, quaternium-18 bentonite such as BENTONE 3, 38, and 38V (from Elementis Specialties, Inc.), TIXOGEL VP (from United Catalysis Corp.), and CLAYTONE® 34, 40, and XL (from Southern Clay Products, Inc.); stearalkonium bentonite such as BENTONE 27 (from Elementis Specialties, Inc.), TIXOGEL LG (from United Catalysis Corp.), and CLAYTONE® AF and APA (from Southern Clay Products, Inc.); and quaternium-18 benzalkonium bentonite such as CLAYTONE® HT and PS (from Southern Clay Products, Inc.). Among these materials, CLAYTONE® AF and APA are preferably used.

Specific examples of modified layered inorganic minerals which are partially modified with an organic anion include, but are not limited to, a hydrotalcite compound DHT-4A (from Kyowa Chemical Industry Co., Ltd.) modified with an organic anion HITENOL 330T (from Dai-ichi Kogyo Seiyaku Co., Ltd.) having the following formula (1):

$$R_1(OR_2)nOSO_3M \quad (1)$$

wherein $R_1$ represents an alkyl group having 13 carbon atoms, $R_2$ represents an alkylene group having 2 to 6 carbon groups, n represents an integer of from 2 to 10, and M represents a monovalent metallic element.

The modified layered mineral tends to present at an interface between the toner constituent liquid and the aqueous medium because of having a proper hydrophobicity. Accordingly, the modified layered mineral localizes at the surface of the resultant toner particles and provides good charge ability.

The toner of the present invention preferably has a ratio (Dv/Dn) of the volume average particle diameter (Dv) to the number average particle diameter (Dn) of from 1.00 to 1.30. Such a toner is capable of providing high resolution and high quality images. When such a toner is used for a two-component developer, the average particle diameter of toner particles in the two-component developer hardly changes even when consumption and supply of toner particles are repeated for an extended period of time. Accordingly, the developer is capable of providing reliable developability even after being agitated in a developing device for an extended period of time.

The toner of the present invention preferably has a volume average particle diameter of from 3.0 to 7.0 μm. Generally speaking, the smaller the average particle diameter of a toner, the better the resultant image resolution and quality. By contrast, the smaller the average particle diameter of a toner, the worse transferability and cleanability of the toner. When a toner having a volume average particle diameter less than 3 μm is used for a two-component developer, the toner may adhere to the surface of a carrier, thereby degrading charging ability of the carrier. When such a toner is used for a one-component developer, the toner may easily adhere to a developing roller or a toner-layer-forming blade. Specifically, when a toner includes fine toner particles having a particle diameter of 2 μm or less in an amount greater than 20%, such fine toner particles may adhere to a carrier, resulting in unreliable charging ability of the carrier. When the volume average particle diameter is in beyond the above-described range, the toner hardly produces high definition and high quality images. Moreover, when such a toner is used for a two-component developer, the average particle diameter of toner particles in the two-component developer largely changes when consumption and supply of toner particles are repeated.

As described above, a small-sized toner with a narrow particle diameter distribution has poor cleanability. In this case, the toner preferably has an average circularity of from 0.93 to 0.97.

The relation between shape and transferability of a toner will be described below. In a full-color copier, a greater amount of toners of different colors are transferred onto a photoreceptor compared to in a monochrome copier using only a black monochrome toner. Therefore, if the toners in the full-color copier have an irregular shape, transfer efficiency may be poor. Further, an irregular-shaped toner tends to adhere to or form an undesirable film thereof on surfaces of a photoreceptor and an intermediate transfer member due to shear force and/or friction force generated between the photoreceptor and a cleaning member, between the intermediate transfer member and the cleaning member, and/or between the photoreceptor and the intermediate transfer member, resulting in poor transfer efficiency. Consequently, toner images of four colors may be unevenly transferred onto the intermediate transfer member, thereby causing unevenness and unbalance in color in the resultant image. It is difficult to produce high quality full-color images with an irregular-shaped full-color toner.

When a toner has an average circularity of from 0.93 to 0.97, the toner may have both satisfactory cleanability and transferability, particularly when the toner is cleaned using a blade. It should be noted that cleanability also depends on the material of the blade and how the blade contacts the photoreceptor, and transferability also depends on conditions of image forming processes. When the average circularity is too large, the toner may be hardly cleaned using a blade. When the average circularity is too small, the toner may have poor transferability.

The circularity of a toner can be measured using a flow particle image analyzer such as FPIA-1000 (from Sysmex Corporation), for example, as follows.

First, water is filtered to remove fine particles of impurities so that in an amount 20 or less particles, of which diameters are in a measurement range, are included per $10^{-3}$ $cm^3$ of the water. Next, several drops of a nonionic surfactant, preferably CONTAMINON N (from Wako Pure Chemical Industries, Ltd.), are added to 10 ml of the water, and 5 mg of a sample is further added thereto. The water containing the sample is subjected to a dispersion treatment for 1 minute using an ultrasonic disperser UH-50 (from SMT Co., Ltd.) at conditions of 20 kHz and 50 W/10 $cm^3$, and further for 5 minutes, to prepare a sample dispersion containing 4000 to 8000 particles, of which diameters are in the measurement range, per 10 $cm^3$ of the sample dispersion.

The sample solution thus prepared is passed through a flow path which extends along a direction of flow of a flat transparent flow cell having a thickness of about 200 μm. A stroboscopic lamp and a CCD camera are disposed on opposite sides of the flow cell so that an optical path is formed crossing the flow cell in a direction of thickness. The stroboscopic lamp flashes at intervals of 1/30 second while the sample solution is passed through the flow cell, so that images of particles passing through the flow cell are acquired. Accordingly, two-dimensional images of the particles being parallel to the flow cell are photographed. The circularity of each of the photographed particles is calculated from the two-dimensional image thereof.

The circularity is defined as follows:

$$\text{Circularity}=Cs/Cp$$

wherein Cp represents the length of the circumference of the image of a particle and Cs represents the length of the circumference of a circle having the same area as that of the image of the particle.

The average particle diameter and particle diameter distribution of a toner can be measured using an instrument such as COULTER COUNTER TA-II and COULTER MULTISIZER II (both from Beckman Coulter K. K.). In the present invention, a COULTER COUNTER TA-II is preferably used connecting with an interface (from The Institute of Japanese Union of Scientists & Engineers) and a personal computer PC9801 (from NEC Corporation) for outputting particle diameter distributions based on number and volume.

A measurement method is as follows, for example. First, 0.1 to 5 ml of a surfactant (preferably an alkylbenzene sulfonate) is included as a dispersant in 100 to 150 ml of an electrolyte (i.e., 1% NaCl aqueous solution including a first grade sodium chloride such as ISOTON-II from Coulter Electrons Inc.). Next, 2 to 20 mg of a toner is added to the electrolyte and dispersed using an ultrasonic dispersing machine for about 1 to 3 minutes to prepare a toner suspension liquid. The volume and number of toner particles in the toner suspension liquid are measured by the above instrument using an aperture of 100 μm to determine the volume and number distribution thereof.

The following 13 channels are preferably used for the measurement: from 2.00 to less than 2.52 μm; from 2.52 to less than 3.17 μm; from 3.17 to less than 4.00 μm; from 4.00 to less than 5.04 μm; from 5.04 to less than 6.35 μm; from 6.35 to less than 8.00 μm; from 8.00 to less than 10.08 μm; from 10.08 to less than 12.70 μm; from 12.70 to less than 16.00 μm; from 16.00 to less than 20.20 μm; from 20.20 to less than 25.40 μm; from 25.40 to less than 32.00 μm; and from 32.00 to less than 40.30 μm. Namely, particles having a particle diameter of from not less than 2.00 μm to less than 40.30 μm can be measured. The volume average particle diameter (Dv) and the number average particle diameter (Dn) are determined from the volume and number distributions, respectively, and the ratio (Dv/Dn) is calculated.

The inventors of the present invention found that the acid value of a toner is an important indicator of low-temperature fixability and hot offset resistance thereof. Specifically, the acid value of the toner of the present invention originates from carboxyl groups on ends of an unmodified polyester, which may be included in the toner as a binder resin. The unmodified polyester preferably has an acid value of from 0.5 to 40.0 mgKOH/g so that fixability (e.g., the minimum and maximum fixable temperatures) of the toner is controllable. When the acid value is too large, the above-described modified polyester may be elongated or cross-linked insufficiently, resulting in poor hot offset resistance. When the acid value is too small, the toner constituent liquid cannot be reliably dispersed by a basic compound when the toner is manufactured. Consequently, the modified polyester easily elongates or cross-links, resulting in unreliable manufacturability.

The acid value of a toner can be measured based on a method according to JIS K0070. In a case where the toner is insoluble in the solvent described therein, dioxane, THF, and the like can be used. The measurement can be performed under the following conditions, for example.

Measuring Instrument: DL-53 TITRATOR (from Mettler Toledo)

Electrode: DG113-SC (from Mettler Toledo)

Analysis Software: LabX Light Version 1.00.000

Calibration of the Instrument: Using mixed solvent of 120 ml of toluene and 30 ml of ethanol Measuring Temperature: 23° C.

A detailed measurement condition is as follows, for example.

Stir
Speed [%] 25
Time [s] 15
EQP titration
Titrant/Sensor
Titrant CH3on a
Concentration [mol/L] 0.1
Sensor DG115
Unit of measurement mV
Predispersing to volume
Volume [mL] 1.0
Wait time [s] 0
Titrant addition Dynamic
dE(set) [mV] 8.0
dV(min) [mV] 0.03
dV(max) [mL] 0.5
Measure mode Equilibrium controlled
dE [mV] 0.5
dt [s] 1.0
t(min) [s] 2.0
t(max) [s] 20.0
Recognition
Threshold 100.0
Steepest jump only No
Range No
Tendency None
Termination
at maximum volume [mL] 10.0
at potential No
at slope No
after number EQPs Yes
n=1
comb. termination conditions No
Evaluation
Procedure Standard
Potential 1 No
Potential 2 No
Stop for reevaluation No The toner of the present invention preferably has a glass transition temperature (Tg) of from 40 to 70° C. so as to satisfy low-temperature fixability, thermostable preservability, and durability. When the glass transition temperature is too small, toner blocking may occur in a developing device and an undesirable toner film may be formed on a photoreceptor. When the glass transition temperature is too large, low-temperature fixability of the toner may deteriorate.

The glass transition temperature (Tg) of a toner can be measured using a TG-DSC system TAS-100 (from Rigaku Corporation) at a temperature rising rate of 10° C./min, for example.

The measurement can be performed as follows. First, about 10 mg of a sample is contained in an aluminum sample container. The sample container is placed on a holder unit and set in an electric furnace. The sample is heated from room temperature to 150° C. at a temperature rising rate of 10° C./min, and allowed to stand at 150° C. for 10 minutes. Subsequently, the sample is cooled to room temperature and allowed to stand for 10 minutes. The sample is subjected to a DSC measurement in which the sample is heated to 150° C. again at a temperature rising rate of 10° C./min in nitrogen atmosphere. The Tg is determined from an intersection point of a tangent line of an endothermic curve adjacent to the Tg and a base line.

The toner of the present invention preferably includes a release agent in an amount of from 3 to 6% by weight. When the amount is too small, the toner may not express sufficient releasability, resulting in poor fixability. When the amount is too large, the toner may easily form an undesirable film thereof on a photoreceptor, etc. A wax having a low melting point of from 50 to 120° C. is preferably used as the release agent. Such a wax effectively functions as a release agent at an interface between a fixing roller and a toner. Accordingly, the toner may have good resistance to hot offset without applying any release agent to the fixing roller.

The melting point of a wax is defined as a temperature at which a maximum endothermic peak is observed in differential scanning calorimetry (DSC).

Specific preferred examples of usable waxes include, but are not limited to, carnauba wax, ester wax, and hydrocarbon wax. These waxes have absorbance at 2850 $cm^{-1}$ measured by the FTIR-ATR method. In a preferred embodiment using a wax as the release agent, the binder resin does not have an absorbance at this wave number, and the absorbance ratio uses the absorbance at 828 $cm^{-1}$ as representing the absorbance specific to the release agent. From the viewpoint of compatibility with a binder resin, hydrocarbon waxes are preferably used. Specifically, paraffin wax, polyethylene wax, and polypropylene wax are more preferably used, and paraffin wax is most preferably used.

Specific examples of colorants for use in the toner of the present invention include any known dyes and pigments such as carbon black, Nigrosine dyes, black iron oxide, NAPHTHOL YELLOW S, HANSA YELLOW (10G, 5G and G), Cadmium Yellow, yellow ironoxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. These materials can be used alone or in combination. The toner typically includes the colorant in an amount of from 1 to 15% by weight, and preferably from 3 to 10% by weight.

The colorant for use in the present invention can be combined with a resin to be used as a master batch. Specific examples of the resin for use in the master batch include, but are not limited to, polyester, polymers of styrenes or substitutions thereof (e.g., polystyrene, poly-p-chlorostyrene, polyvinyl toluene), styrene copolymers (e.g., styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloro methacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic acid ester copolymer), polymethyl methacrylate, polybutyl methacrylate, polyvinyl chloride, polyvinyl acetate, polyethylene, polypropylene, epoxy resins, epoxy-polyol resins, polyurethane, polyamide, polyvinyl butyral, polyacrylic acid resins, rosin, modified rosin, terpene resins, aliphatic hydrocarbon resins, alicyclic hydrocarbon resins, aromatic petroleum resins, chlorinated paraffin, and paraffin wax. These resins can be used alone or in combination.

The master batches can be prepared by mixing one or more of the resins as mentioned above and the colorant as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed, can be preferably used because the resultant wet cake can be used as it is without being dried. When performing the mixing and kneading process, dispersing devices capable of applying a high shearing force such as three roll mills can be preferably used.

The toner of the present invention may include a charge controlling agent, if desired. Specific examples of usable charge controlling agent include, but are not limited to, Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing surfactants, metal salts of salicylic acid, and metal salts of salicylic acid derivatives.

Specific examples of commercially available charge controlling agents include, but are not limited to, BONTRON® N-03 (Nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as sulfonate group, carboxyl group, and a quaternary ammonium group.

The content of the charge controlling agent is determined depending on the species of the binder resin used, and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large a charge quantity, and thereby the electrostatic force of a developing roller attracting the toner increases, resulting in deterioration of the fluidity of the toner and image density of the toner images. The charge controlling agent can be melt-mixed with a master batch or a bonder resin. Of course, the charge controlling agent can be dissolved or dispersed in the toner constituent liquid. Alternatively, the charge controlling agent can be externally added to the toner using a HENSCHEL MIXER.

To improve fluidity, developability, and charge ability, particulate inorganic materials may be externally added to the toner of the present invention. The particulate inorganic material preferably has a primary particle diameter of from 5 nm to 2 μm, and more preferably from 5 to 500 nm; and a specific surface area based on BET method of from 20 to 500 $m^2/g$. The toner preferably includes the particulate inorganic material in an amount of from 0.01 to 5% by weight, and more preferably from 0.01 to 2.0% by weight. Specific examples of usable inorganic materials include, but are not limited to, silica, alumina, titanium oxide, barium titanate, magnesium titanate, calcium titanate, strontium titanate, zinc oxide, tin oxide, quartz sand, clay, mica, sand-lime, diatomearth, chromiumoxide, ceriumoxide, redironoxide, antimonytrioxide, magnesiumoxide, zirconium oxide, barium sulfate, barium carbonate, calcium carbonate, silicon carbide, and silicon nitride. Among these materials, a mixture of fine particles of a hydrophobized silica and a hydrophobized titanium oxide is preferably used as a fluidizer. Specifically, when the mixture of fine particles of a hydrophobized silica and a hydrophobized titanium oxide has an average particle diameter of 50 mμ or less, electrostatic force and van der Waals force between the toner and the mixture drastically improves. Therefore, the fine particles hardly release from the toner even if the toner is agitated in a developing device to be properly charged. Accordingly, high quality images may be obtained and a less amount of residual toner particles may remain on a photoreceptor.

The toner of the present invention is obtainable by a method using an aqueous medium. The following is a description of an example of a method of manufacturing the toner of the present invention.

As the aqueous medium, water alone or a mixture of water and a solvent miscible with water can be used. Specific examples of usable water-miscible solvents include, but are not limited to, alcohols (e.g., methanol, isopropanol, ethylene glycol), dimethylformamide, tetrahydrofuran, cellosolves (e.g., methyl cellosolve), and lower ketones (e.g., acetone, methyl ethyl ketone).

In the present invention, for example, a reactive modified polyester, such as a polyester prepolymer (A) having an isocyanate group, is reacted with an amine (B) in the aqueous medium, so that a modified polyester, such as an urea-modified polyester, is obtained. To form a reliable dispersion containing the modified polyester (e.g., an urea-modified polyester) and the reactive modified polyester (e.g., a polyester prepolymer (A)), toner constituents including the reactive modified polyester may be dispersed in the aqueous medium by application of shearing force. The reactive modified polyester may be mixed with other toner constituents such as a colorant, a colorant master batch, a release agent, a charge controlling agent, and an unmodified polyester at a time the above-described dispersion is formed. Alternatively, the reactive modified polyester and other toner constituents may be previously mixed, so that the mixture is dispersed in the aqueous medium at once. The latter is more preferable. The other toner constituents such as a release agent and a charge controlling agent do not necessarily need to be added when being dispersed in an aqueous medium. These agents may be externally added to the resultant particles.

Any known dispersing machines such as low-speed shearing type, high-speed shearing type, friction type, high pressure jet type, and ultrasonic type can be used for the dispersion. In order to prepare a dispersion including particles having an average particle diameter of from 2 to 20 μm, a high-speed shearing type dispersing machine is preferably used. When high-speed shearing type dispersing machines are used, the rotation speed of rotors is typically from 1,000 to 30,000 rpm, and preferably from 5,000 to 20,000 rpm, but not limited thereto. The dispersing time is typically from 0.1 to 5 minutes in batch type dispersing machines, but not limited thereto. The temperature in the dispersing process is typically from 0 to 150° C. (under pressure), and preferably from 40 to 98° C. The higher the temperature, the lower the viscosity of the dispersion containing the modified polyester (e.g., an urea-modified polyester) and the reactive modified polyester (e.g., a polyester prepolymer (A)), resulting in easy formation of dispersion.

The amount of the aqueous medium is typically from 50 to 2000 parts by weight, and preferably from 100 to 1000 parts by weight, based on 100 parts by weight of the toner constituents including the modified polyester (e.g., an urea-modified polyester) and there active modified polyester (e.g., a polyester prepolymer (A)). When the amount is too small, the toner constituent liquid may be unevenly dispersed, resulting in production of undesired-sized toner particles. When the amount is too large, manufacturing cost may increase.

Dispersing agents may be optionally used when the toner constituent liquid is dispersed or emulsified in the aqueous medium, so as to improve stability of the dispersion and to narrow the particle diameter distribution of the resultant toner. Usable dispersing agents include surfactants, particulate inorganic materials, and particulate polymers.

Specific examples of usable surfactants include, but are not limited to, anionic surfactants such as alkylbenzene sulfonates, α-olefin sulfonates, and phosphates; cationic surfactants such as amine salts (e.g., alkylamine salts, amino alcohol aliphatic acid derivatives, polyamine aliphatic acid derivatives, imidazoline) and quaternary ammonium salts (e.g., alkyl trimethyl ammonium salts, dialkyl dimethyl ammonium salts, alkyl dimethyl benzyl ammonium salts, pyridinium salts, alkyl isoquinolinium salts, benzethonium chloride); nonionic surfactants such as aliphatic amide derivatives and polyvalent alcohol derivatives; and ampholytic surfactants such as alanine, dodecyl di(aminoethyl)glycine, di(octyl aminoethyl)glycine, and alkyl-N,N-dimethyl ammonium betaine.

Surfactants having a fluoroalkyl group are effective even in small amounts. Specific preferred examples of usable anionic surfactants having a fluoroalkyl group include, but are not limited to, fluoroalkyl carboxylic acids having 2 to 10 carbon atoms and metal salts thereof, perfluorooctane sulfonyl glutamic acid disodium, 3-[ω-fluoroalkyl(C6-C11)oxy]-1-alkyl(C3-C4)sulfonic acid sodium, 3-[ω-fluoroalkanoyl(C6-C8)-N-ethylamino]-1-propane sulfonic acid sodium, fluoroalkyl(C11-C20)carboxylic acids and metal salts thereof, perfluoroalkyl(C7-C13)carboxylic acids and metal salts thereof, perfluoroalkyl(C4-C12)sulfonic acids and metal salts thereof, perfluorooctane sulfonic acid dimethanol amide, N-propyl-N-(2-hydroxyethyl)perfluorooctane sulfonamide, perfluoroalkyl(C6-C10)sulfonamide propyl trimethyl ammonium salts, perfluoroalkyl(C6-C10)-N-ethyl sulfonyl glycine salts, and monoperfluoroalkyl(C6-C16)ethyl phosphates.

Specific examples of usable commercially available anionic surfactants having a fluoroalkyl group include, but are not limited to, SARFRON® S-111, S-112 and S-113 (manufactured by Asahi Glass Co., Ltd.); FLUORAD® FC-93, FC-95, FC-98 and FC-129 (manufactured by Sumitomo 3M Ltd.); UNIDYNE® DS-101 and DS-102 (manufactured by Daikin Industries, Ltd.); MEGAFACE® F-110, F-120, F-113, F-191, F-812 and F-833 (manufactured by Dainippon Ink and Chemicals, Inc.); ECTOP® EF-102, 103, 104, 105, 112, 123A, 123B, 306A, 501, 201 and 204 (manufactured by Tochem Products Co., Ltd.) and FUTARGENT® F-100 and F-150 (manufactured by Neos).

Specific preferred examples of usable cationic surfactants having a fluoroalkyl group include, but are not limited to, aliphatic primary, secondary, and tertiary amine acids having a fluoroalkyl group, aliphatic tertiary ammonium salts such as perfluoroalkyl(C6-C10)sulfonamide propyl trimethyl ammonium salts, benzalkonium salts, benzethonium chloride, pyridinium salts, and imidazolinium salts.

Specific examples of usable commercially available cationic surfactants include, but are not limited to, SARFRON® S-121 (manufactured by Asahi Glass Co., Ltd.); FLUORAD® FC-135 (manufactured by Sumitomo 3M Ltd.); UNIDYNE® DS-202 (manufactured by Daikin Industries, Ltd.); MEGAFACE® F-150 and F-824 (manufactured by Dainippon Ink and Chemicals, Inc.); ECTOP® EF-132 (manufactured by Tohchem Products Co., Ltd.); and FUTARGENT® F-300 (manufactured by Neos).

Specific examples of usable particulate inorganic materials include, but are not limited to, water-insoluble inorganic materials such as tricalcium phosphate, calcium carbonate, titanium oxide, colloidal silica, and hydroxyapatite.

Particulate polymers have the same effect as the particulate inorganic materials. Specific examples of usable particulate polymers include, but are not limited to, a particulate MMA polymer with a diameter of 1 μm or 3 μm, particulate styrene with a diameter of 0.5 μm or 2 μm, and a particulate styrene-acrylonitrile polymer with a diameter of 1 μm. Specific examples of usable commercially available particulate polymers include, but are not limited to, PB-200H (from Kao Corporation), SGP (from Soken Chemical & Engineering Co., Ltd.), TECHPOLYMER SB (from Sekisui Plastics Co., Ltd.), SGP-3G (from Soken Chemical & Engineering Co., Ltd.), and MICROPEARL (from Sekisui Chemical Co., Ltd.).

Polymeric protection colloids may be used in combination with the above-described particulate inorganic materials and polymers to form a reliable dispersion.

Specific examples of the polymeric protection colloids include, but are not limited to, homopolymers and copolymers of monomers such as acid monomers (e.g., acrylic acid, methacrylic acid, α-cyanoacrylic acid, α-cyanomethacrylic acid, itaconic acid, crotonic acid, fumaric acid, maleic acid, maleic anhydride), (meth)acrylic monomers having hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acrylamide, N-methylol methacrylamide), vinyl alcohols and ethers of vinyl alcohols (e.g., vinyl methyl ether, vinyl ethyl ether, vinyl propyl ether), esters of vinyl alcohols with compounds having carboxyl group (e.g., vinyl acetate, vinyl propionate, vinyl butyrate), monomers having amide bond (e.g., acrylamide, methacrylamide, diacetoneacrylamide acid) and methylol compounds thereof, acid chloride monomers (e.g., acrylic acid chloride, methacrylic acid chloride), and monomers having a nitrogen atom or a heterocyclic ring having a nitrogen atom (e.g., vinyl pyridine, vinyl pyrrolidone, vinyl imidazole, ethylene imine); polyoxyethylene resins (e.g., polyoxyethylene, polyoxypropylene, polyoxyethylene alkyl amines, polyoxypropylene alkyl amines, polyoxyethylene alkyl amides, polyoxypropylene alkyl amides, polyoxyethylene nonylphenyl ethers, polyoxyethylene lauryl phenyl ethers, polyoxyethylene stearyl phenyl esters, polyoxyethylene nonyl phenyl esters); and cellulose compounds (e.g., methyl cellulose, hydroxyethyl cellulose, hydroxypropyl cellulose).

To reduce the viscosity of the dispersion containing the toner constituents, a solvent can be used in which the polyester resins, such as the modified polyester (e.g., an urea-modified polyester) and the reactive modified polyester (e.g., a prepolymer (A)), are soluble. The use of such solvents makes the resultant toner have an arrow particle diameter distribution. Specific examples of usable solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. Among these solvents, aromatic solvents such as toluene and xylene, and halogenated hydrocarbons such as methylene chloride, 1,2-dichloroethane, chloroform, and carbon tetrachloride are preferably used. The amount of the solvent is typically 0 to 300 parts by weight, preferably 0 to 100 parts by weight, and more preferably from 25 to 70 parts by weight, per 100 parts by weight of the reactive modified polyester (e.g., a prepolymer (A)). The solvent is removed from the dispersion at normal pressure or a reduced pressure after an elongation and/or cross-linking reaction of the reactive modified polyester (e.g., a prepolymer (A)) with an amine is terminated.

The elongation and/or cross-linking time varies with reactivity, which depends on the kinds of the isocyanate group of the reactive modified polyester (e.g., a prepolymer (A)) or the amine. However, the elongation and/or cross-linking time is typically from 10 minutes to 40 hours, and preferably from 2 to 24 hours. The reaction temperature is typically from 0 to 150° C., and preferably from 40 to 98° C. Any known catalyst, such as dibutyltin laurate and dioctyltin laurate, can be optionally used, if desired. The above-described amine serves as an elongation and/or cross-linking reaction.

Before removing the solvent from the dispersion at the termination of the elongation and/or cross-linking reaction, the dispersion is preferably agitated at a temperature of from 10 to 50° C., so that the shape of the toner is deformed. On the other hand, the ratio (Dv/Dn) of the volume average particle diameter (Dv) to the number average particle diameter (Dn) is controllable by controlling the viscosities of the aqueous medium and the toner constituent liquid, properties and the added amount of the dispersing agent (e.g., a particulate resin), the dispersion diameter of the release agent, etc. Each of the volume average particle diameter (Dv) and the number average particle diameter (Dn) is controllable by controlling properties and the added amount of the dispersing agent (e.g., particulate resin), etc.

The toner of the present invention can be used for a two-component developer by mixing with a magnetic carrier. The two-component developer preferably includes the toner in an amount of from 1 to 10 parts by weight based on 100 parts by weight of the magnetic carrier. As the magnetic carrier, any known carriers having a particle diameter of from 20 to 200 μm can be used, such as ferrite powders, magnetite powders, and magnetic resin carriers. The carrier preferably has a cover layer on the surface thereof including a resin such as amino resins (e.g., urea-formaldehyde resins, melamine resins, benzoguanamine resins, urea resins, polyamide resins, epoxy resins), polyvinyl and polyvinylidene resins (e.g., acrylic resins, polymethyl methacrylate resins, polyacrylonitrile resins, polyvinyl acetate resins, polyvinyl alcohol resins, polyvinyl butyral resins), polystyrene resins (e.g., polystyrene resins, styrene-acrylic copolymers), halogenated olefin resins (e.g., polyvinyl chloride), polyester resins (e.g., polyethylene terephthalate resins, polybutylene terephthalate resins), polycarbonate resins, polyethylene resins, polyvinyl fluoride resins, polyvinylidene fluoride resins, polytrifluoroethylene resins, polyhexafluoropropylene resins, copolymers of vinylidene fluoride and an acrylic monomer, copolymers of vinylidene fluoride and vinyl fluoride, terpolymers of tetrafluoroethylene, vinylidene fluoride, and a non-fluorinated monomer, and silicone resins.

The cover layer may include a conductive power. Specific examples of usable conductive powers include, but are not limited to, metal powders, carbon black, titanium oxide, tin oxide, and zinc oxide. The conductive power preferably has an average particle diameter of 1 μm or less. When the average particle diameter is too large, electric resistance thereof maybe hardly controlled.

Of course, the toner of the present invention can be used for a one-component magnetic or non-magnetic toner.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Manufacturing Example of Polyester

In a reaction vessel equipped with a condenser, a stirrer, and a nitrogen inlet pipe, 690 parts of ethylene oxide 2 mol adduct of bisphenol A and 256 parts of terephthalic acid are contained. The mixture is subjected to a polycondensation reaction for 8 hours at 230° C. at normal pressures, and subsequently for 5 hours under a reduced pressure of from 10 to 15 mmHg. The mixture is then cooled to 160° C., and 18 parts of phthalic anhydride are added thereto. The mixture is further reacted for 2 hours. Thus, a polyester (1), which is unmodified, is prepared.

The unmodified polyester (1) has a weight average molecular weight of 4,000, an acid value of 10 mgKOH/g, and a glass transition temperature of 50° C.

Manufacturing Example of Prepolymer

In a reaction vessel equipped with a condenser, a stirrer, and a nitrogen inlet pipe, 800 parts of ethylene oxide 2 mol adduct of bisphenol A, 180 parts of isophthalic acid, 60 parts of terephthalic acid, and 2 parts of dibutyltin oxide are contained. The mixture is subjected to a reaction for 8 hours at 230° C. at normal pressures, and subsequently for 5 hours under a reduced pressure of from 10 to 15 mmHg while dehydrating. The mixture is then cooled to 160° C., and 32 parts of phthalic anhydride are added thereto. The mixture is further reacted for 2 hours.

The mixture is further cooled to 80° C., and 170 parts of isophorone diisocyanate are added thereto. The mixture is further reacted for 6 hours in ethyl acetate. Thus, a prepolymer (1) having an isocyanate group is prepared.

Manufacturing Example of Wax Dispersion 1

To prepare a wax dispersion (1), 70 parts of ethyl acetate, 25 parts of the polyester (1), and 5 parts of a paraffin wax having a melting point of 68° C. are mixed with 60% by volume of zirconia beads having a diameter of 1 mm, and the mixture is agitated for 24 hours using a paint conditioner No. 5400 (from Red Devil). Wax particles in the wax dispersion (1) have a volume average particle diameter (Dv) of 0.18 μm, measured by a Particle Size Distribution Analyzer LA-920 (from Horiba, Ltd.).

Manufacturing Example of Wax Dispersion 2

To prepare a wax dispersion (2), 70 parts of ethyl acetate, 25 parts of the polyester (1), and 5 parts of a paraffin wax having a melting point of 68° C. are mixed with 60% by volume of zirconia beads having a diameter of 1 mm, and the mixture is agitated for 18 hours using a paint conditioner No. 5400 (from Red Devil). Wax particles in the wax dispersion (2) have a volume average particle diameter (Dv) of 0.22 μm, measured by a Particle Size Distribution Analyzer LA-920 (from Horiba, Ltd.).

Manufacturing Example of Wax Dispersion 3

To prepare a wax dispersion (3), 70 parts of ethyl acetate, 25 parts of the polyester (1), and 5 parts of a paraffin wax having a melting point of 68° C. are mixed with 60% by volume of zirconia beads having a diameter of 1 mm, and the mixture is agitated for 12 hours using a paint conditioner No. 5400 (from Red Devil). Wax particles in the wax dispersion (3) have a volume average particle diameter (Dv) of 0.32 μm, measured by a Particle Size Distribution Analyzer LA-920 (from Horiba, Ltd.).

Manufacturing Example of Wax Dispersion 4

To prepare a wax dispersion (4), 70 parts of ethyl acetate, 25 parts of the polyester (1), and 5 parts of a paraffin wax having a melting point of 68° C. are mixed with 60% by volume of zirconia beads having a diameter of 1 mm, and the mixture is agitated for 36 hours using a paint conditioner No. 5400 (from Red Devil). Wax particles in the wax dispersion (4) have a volume average particle diameter (Dv) of 0.11 μm, measured by a Particle Size Distribution Analyzer LA-920 (from Horiba, Ltd.).

Manufacturing Example of Wax Dispersion 5

To prepare a wax dispersion (5), 70 parts of ethyl acetate, 25 parts of the polyester (1), and 5 parts of a paraffin wax having a melting point of 68° C. are mixed with 60% by volume of zirconia beads having a diameter of 1 mm, and the mixture is agitated for 6 hours using a paint conditioner No. 5400 (from Red Devil). Wax particles in the wax dispersion (5) have a volume average particle diameter (Dv) of 0.48 μm, measured by a Particle Size Distribution Analyzer LA-920 (from Horiba, Ltd.).

Manufacturing Example of Wax Dispersion 6

To prepare a wax dispersion (6), 70 parts of ethyl acetate, 25 parts of the polyester (1), and 5 parts of a carnauba wax having a melting point of 85° C. are mixed with 60% by volume of zirconia beads having a diameter of 1 mm, and the mixture is agitated for 6 hours using a paint conditioner No. 5400 (from Red Devil). Wax particles in the wax dispersion (6) have a volume average particle diameter (Dv) of 0.48 μm, measured by a Particle Size Distribution Analyzer LA-920 (from Horiba, Ltd.).

Preparation of Particulate Resin Dispersion

In a reaction vessel equipped with a stirrer and a thermometer, 683 parts of water, 20 parts of a sodium salt of sulfate of ethylene oxide adduct of methacrylic acid (ELEMINOL RS-30 from Sanyo Chemical Industries, Ltd.), 78 parts of styrene, 78 parts of methacrylic acid, 120 parts of butyl acrylate, and 1 part of ammonium persulfate are contained, and agitated for 15 minutes at a revolution of 400 rpm. Thus a whitish emulsion is prepared. The emulsion is heated to 75° C. and reacted for 5 hours. Subsequently, 30 parts of a 1% aqueous solution of ammonium persulfate are added to the emulsion, and aged for 5 hours at 75° C. Thus, a particulate resin dispersion (1), which is an aqueous dispersion of a vinyl resin (i.e., a copolymer of styrene, methacrylic acid, butyl acrylate, and a sodium salt of sulfate of ethylene oxide adduct of methacrylic acid), is prepared. Particles of the vinyl resin in the particulate resin dispersion (1) have a volume average particle diameter (Dv) of 55 nm, measured by NANOTRAC® UPA-150EX (from Nikkiso Co., Ltd.).

Preparation of Aqueous Medium

To prepare an aqueous medium, 990 parts of water, 83 parts of the particulate dispersion (1), 37 parts of a 48.5% aqueous solution of dodecyl diphenyl ether disulfonic acid sodium (ELEMINOL MON-7 from Sanyo Chemical Industries, Ltd.), and 90 parts of ethyl acetate are mixed and agitated. Thus, an aqueous medium (1), which is a milky liquid, is prepared.

Preparation of Pigment Master Batch

In a reaction vessel equipped with a condenser, a stirrer, and a nitrogen inlet pipe, 319 parts of propylene oxide 2 mol adduct of bisphenol A, 449 parts of ethylene oxide 2 mol adduct of bisphenol A, 243 parts of terephthalic acid, 53 parts of adipic acid, and 2 parts of dibutyltin oxide are contained. The mixture is subjected to a reaction for 8 hours at 230° C. at normal pressures, and subsequently for 5 hours at a reduced pressure of from 10 to 15 mmHg. Further, 7 parts of trimellitic anhydride are added thereto, and the mixture is reacted for 2 hours at 180° C. at normal pressures. Thus a polyester (A) for use in master batch is prepared.

The polyester (A) has a number average molecular weight of 1900, a weight average molecular weight of 6100, and an acid value of 1.1 mgKOH/g.

Next, 30 parts of water, 40 parts of C. I. Pigment Red 122 (MAGENTA R from Toyo Ink Mfg. Co., Ltd.), and 60 parts of the polyester (A) are mixed using a HENSCHEL MIXER (from Mitsui Mining Co., Ltd.). Thus, a mixture in which water is immersed into pigment aggregations is prepared. The mixture is kneaded for 45 minutes using a double-roll mill, the surface temperature of which is set to 130° C., and the kneaded mixture is rolled and cooled. The rolled mixture is pulverized using a pulverizer. Thus, a master batch (1) is prepared.

Preparation of Inorganic Mineral Master Batch

First, 30 parts of water, 40 parts of CLAYTON® APA (from Southern Clay Products, Inc.), and 60 parts of the polyester (A) are mixed using a HENSCHEL MIXER (from Mitsui Mining Co., Ltd.). Thus, a mixture in which water is immersed into in organic mineral aggregations is prepared. The mixture is kneaded for 45 minutes using a double-roll mill, the surface temperature of which is set to 130° C., and the kneaded mixture is rolled and cooled. The rolled mixture is pulverized using a pulverizer. Thus, a master batch (2) is prepared.

Preparation of Colorant-Wax Dispersion 1

In a reaction vessel equipped with a stirrer and a thermometer, 30 parts of a 65% ethyl acetate solution of the polyester (1), 50 parts of the wax dispersion (1), 20 parts of a 50% ethyl acetate solution of the master batch (1), and 1.5 parts of the master batch (2) are contained, and heated to 80° C. while being agitated. The mixture is kept at 80° C. for 5 hours and cooled to 30° C. over a period of 1 hour. Thus, a colorant-wax dispersion (1) is prepared.

Preparation of Colorant-Wax Dispersion 2

In a reaction vessel equipped with a stirrer and a thermometer, 30 parts of a 65% ethyl acetate solution of the polyester (1), 50 parts of the wax dispersion (2), 20 parts of a 50% ethyl acetate solution of the master batch (1), and 1.5 parts of the master batch (2) are contained, and heated to 80° C. while being agitated. The mixture is kept at 80° C. for 5 hours and cooled to 30° C. over a period of 1 hour. Thus, a colorant-wax dispersion (2) is prepared.

Preparation of Colorant-Wax Dispersion 3

In a reaction vessel equipped with a stirrer and a thermometer, 30 parts of a 65% ethyl acetate solution of the polyester (1), 50 parts of the wax dispersion (3), 20 parts of a 50% ethyl acetate solution of the master batch (1), and 1.5 parts of the master batch (2) are contained, and heated to 80° C. while being agitated. The mixture is kept at 80° C. for 5 hours and cooled to 30° C. over a period of 1 hour. Thus, a colorant-wax dispersion (3) is prepared.

Preparation of Colorant-Wax Dispersion 4

In a reaction vessel equipped with a stirrer and a thermometer, 30 parts of a 65% ethyl acetate solution of the polyester (1), 80 parts of the wax dispersion (1), 20 parts of a 50% ethyl acetate solution of the master batch (1), and 1.9 parts of the master batch (2) are contained, and heated to 80° C. while being agitated. The mixture is kept at 80° C. for 5 hours and cooled to 30° C. over a period of 1 hour. Thus, a colorant-wax dispersion (4) is prepared.

Preparation of Colorant-Wax Dispersion 5

In a reaction vessel equipped with a stirrer and a thermometer, 30 parts of a 65% ethyl acetate solution of the polyester (1), 80 parts of the wax dispersion (2), 20 parts of a 50% ethyl acetate solution of the master batch (1), and 1.9 parts of the master batch (2) are contained, and heated to 80° C. while being agitated. The mixture is kept at 80° C. for 5 hours and cooled to 30° C. over a period of 1 hour. Thus, a colorant-wax dispersion (5) is prepared.

Example 1

First, 664 parts of the colorant-wax dispersion (1), 114 parts of the prepolymer (1), and 3.1 parts of isophorone diamine are mixed for 1 minute using a TK HOMOMIXER (from Tokushu Kika Kogyo Co., Ltd.) at a revolution of 5000 rpm. Further, 1200 parts of the aqueous medium (1) are added thereto, and the mixture is mixed for 20 minutes using the TK HOMOMIXER at a revolution of 10000 rpm. Thus, an emulsion slurry (1) is prepared.

The emulsion slurry (1) is contained in a vessel equipped with a stirrer and a thermometer, and subjected to solvent removal for 8 hours at 30° C. Thus, a dispersion slurry (1) is prepared.

Next, 100 parts of the dispersion slurry (1) is filtered under a reduced pressure to obtain a wet cake. The wet cake thus obtained is mixed with 100 parts of ion-exchange water and the mixture is agitated for 10 minutes using a TK HOMOMIXER at a revolution of 12000 rpm, followed by filtering. Thus, a wet cake (i) is prepared.

The wet cake (i) is mixed with 100 parts of a 10% aqueous solution of sodium hydroxide and the mixture is agitated for 30 minutes using a TK HOMOMIXER at a revolution of 12000 rpm, followed by filtering under a reduced pressure. Thus, a wet cake (ii) is prepared.

The wet cake (ii) is mixed with 100 parts of a 10% hydrochloric acid and the mixture is agitated for 10 minutes using a TK HOMOMIXER at a revolution of 12000 rpm, followed by filtering. Thus, a wet cake (iii) is prepared.

The wet cake (iii) is mixed with 300 parts of ion-exchange water and the mixture is agitated for 10 minutes using a TK HOMOMIXER at a revolution of 12000 rpm, followed by filtering. This operation is repeated twice. Thus, a wet cake (iv) is prepared.

The wet cake (iv) is dried for 48 hours at 40° C. using a circulating air drier, followed by sieving with a screen having openings of 75 μm. Thus, a mother toner (1) is prepared.

Next, 100 parts of the mother toner (1) are mixed with 0.5 parts of a hydrophobized silica (surface-treated with hexamethyldisilazane, having a specific surface area of 200 $m^2/g$) and 0.5 parts of a hydrophobized rutile type titanium oxide (surface-treated with isobutyl trimethoxysilane, having an average primary particle diameter of 0.02 μm) using a HENSCHEL MIXER. Thus, a toner (1) is prepared.

Example 2

The procedure for preparation of the toner (1) in Example 1 is repeated except that the colorant-wax dispersion (1) is replaced with the colorant-wax dispersion (2). Thus, a toner (2) is prepared.

Example 3

The procedure for preparation of the toner (1) in Example 1 is repeated except that the colorant-wax dispersion (1) is replaced with the colorant-wax dispersion (3). Thus, a toner (3) is prepared.

Example 4

The procedure for preparation of the toner (1) in Example 1 is repeated except that the colorant-wax dispersion (1) is replaced with the colorant-wax dispersion (4) and the amount of the prepolymer (1) is changed from 114 parts to 112 parts. Thus, a toner (4) is prepared.

Example 5

The procedure for preparation of the toner (1) in Example 1 is repeated except that the colorant-wax dispersion (1) is replaced with the colorant-wax dispersion (5) and the amount of the prepolymer (1) is changed from 114 parts to 112 parts. Thus, a toner (5) is prepared.

Preparation of Colorant-Wax Dispersion 6

In a reaction vessel equipped with a stirrer and a thermometer, 30 parts of a 65% ethyl acetate solution of the polyester (1), 50 parts of the wax dispersion (4), 20 parts of a 50% ethyl acetate solution of the master batch (1), and 1.5 parts of the master batch (2) are contained, and heated to 80° C. while being agitated. The mixture is kept at 80° C. for 5 hours and cooled to 30° C. over a period of 1 hour. Thus, a colorant-wax dispersion (6) is prepared.

Preparation of Colorant-Wax Dispersion 7

In a reaction vessel equipped with a stirrer and a thermometer, 30 parts of a 65% ethyl acetate solution of the polyester (1), 50 parts of the wax dispersion (5), 20 parts of a 50% ethyl acetate solution of the master batch (1), and 1.5 parts of the master batch (2) are contained, and heated to 80° C. while being agitated. The mixture is kept at 80° C. for 5 hours and cooled to 30° C. over a period of 1 hour. Thus, a colorant-wax dispersion (7) is prepared.

Preparation of Colorant-Wax Dispersion 8

In a reaction vessel equipped with a stirrer and a thermometer, 30 parts of a 65% ethyl acetate solution of the polyester (1), 50 parts of the wax dispersion (6), 20 parts of a 50% ethyl acetate solution of the master batch (1), and 1.5 parts of the master batch (2) are contained, and heated to 80° C. while being agitated. The mixture is kept at 80° C. for 5 hours and cooled to 30° C. over a period of 1 hour. Thus, a colorant-wax dispersion (8) is prepared.

Comparative Example 1

The procedure for preparation of the toner (1) in Example 1 is repeated except that the colorant-wax dispersion (1) is replaced with the colorant-wax dispersion (6). Thus, a toner (6) is prepared.

Comparative Example 2

The procedure for preparation of the toner (1) in Example 1 is repeated except that the colorant-wax dispersion (1) is replaced with the colorant-wax dispersion (7). Thus, a toner (7) is prepared.

Comparative Example 3

The procedure for preparation of the toner (1) in Example 1 is repeated except that the colorant-wax dispersion (1) is replaced with the colorant-wax dispersion (8). Thus, a toner (8) is prepared.

Evaluations (1) Image Granularity and Sharpness

Each of the above-prepared toners is set in a digital full-color copier IMAGIO COLOR 2800 (from Ricoh Co., Ltd.), and a photographic image is produced in monochrome. The produced image is visually observed to evaluate granularity and sharpness. The evaluation results are graded as follows.

A: equal to offset printing images
B: slightly worse than offset printing images
C: significantly worse than offset printing images
D: equal to conventional electrophotographic images (2) Background Fouling Each of the above-prepared toners is set in a digital full-color copier IMAGIO COLOR 2800 (from Ricoh Company, Ltd.), and a running test in which 30,000 sheets of an image having an image ratio of 50% are continuously produced in monochrome is performed. Subsequently, the copier stops operating while a white solid image is developed, and thereafter residual toner particles remaining on a photoreceptor are transferred onto a tape. A difference in image density between the tape on to which the residual toner particles are transferred and a new tape onto which no toner particles are transferred is measured using a SPECTRO DENSITOMETER X-RITE 938 (from X-rite, Incorporated). The smaller the difference in image density, the better the produced image quality. The evaluation results are graded into 4 levels (A (best), B, C, and D (worse)).

(3) Fixability

Each of the above-prepared toners and a paper TYPE 6200 (from Ricoh Company, Ltd.) are set in a copier IMAGIO MF2200 (from Ricoh Company, Ltd.) employing a fixing roller using TEFLON®. Images are produced while varying a temperature of the fixing roller, so that a minimum fixable temperature below which cold offset problem occurs and a maximum fixable temperature above which hot offset problem occurs are determined to evaluate low-temperature fixability and hot offset resistance, respectively. (A conventional toner may have a minimum fixable temperature of from 140 to 150° C.) When the minimum fixable temperature is determined, the linear speed of paper conveyance is from 120 to 150 mm/sec, the surface pressure is 1.2 $kgf/cm^2$, and the nip width is 3 mm. When the maximum fixable temperature is determined, the linear speed of paper conveyance is 50 mm/sec, the surface pressure is 2.0 $kgf/cm^2$, and the nip width is 4.5 mm. The evaluation results are graded as follows.

Low-Temperature Fixability

A: Minimum fixable temperature is less than 140° C.

B: Minimum fixable temperature is from140 to 149° C.

C: Minimum fixable temperature is from150 to 159° C.

D: Minimum fixable temperature is 160° C. or more

Hot Offset Resistance

A: Maximum fixable temperature is 201° C. or more

B: Maximum fixable temperature is from 191 to 200° C.

C: Maximum fixable temperature is from 181 to 190° C.

D: Maximum fixable temperature is 180° C. or less (4) Thermostable Preservability Each of the above-prepared toners is stored for 8 hours at 50° C., and subsequently sieved for 2 minutes using a 42-mesh sieve. The thermostable preservability is evaluated by a residual ratio of toner particles remaining on the sieve. The evaluation results are graded as follows.

A: Residual rate is 30% or more

B: Residual rate is from 20 to 30%

C: Residual rate is from 10 to 20%

D: Residual rate is less than 10%

Properties and evaluation results of the toners are shown in Tables 1 and 2, respectively.

TABLE 1

| | Toner | Wax Amount (% by weight) | ΔATR | Dv (μm) | Dn (μm) | Dv/Dn | Average Circularity | Tg (° C.) | Acid Value (mgKOH/g) |
|---|---|---|---|---|---|---|---|---|---|
| Ex. 1 | 1 | 4.6 | 0.11 | 5.4 | 4.8 | 1.13 | 0.961 | 51.1 | 7.2 |
| Ex. 2 | 2 | 4.6 | 0.14 | 5.3 | 4.6 | 1.15 | 0.957 | 51.3 | 7.3 |
| Ex. 3 | 3 | 4.6 | 0.17 | 5.7 | 4.8 | 1.19 | 0.955 | 51.4 | 7.3 |
| Ex. 4 | 4 | 5.8 | 0.16 | 5.3 | 4.6 | 1.15 | 0.959 | 51.2 | 7.1 |
| Ex. 5 | 5 | 5.8 | 0.19 | 5.3 | 4.5 | 1.18 | 0.955 | 51.3 | 7.1 |
| Comp. Ex. 1 | 6 | 4.6 | 0.08 | 5.1 | 4.6 | 1.11 | 0.964 | 51.3 | 8.3 |
| Comp. Ex. 2 | 7 | 4.6 | 0.22 | 6.1 | 5 | 1.22 | 0.951 | 51.1 | 7.2 |
| Comp. Ex. 3 | 8 | 6 | 0.08 | 5.2 | 4.6 | 1.13 | 0.962 | 51.1 | 7.3 |

ΔATR: a difference in absorbance ratio between a toner heated for 1 minute in an atmosphere of 100° C. and the toner stored in an atmosphere of 23° C.

TABLE 2

| | Toner | Evaluations (1) | (2) | (3-1) | (3-2) | (4) |
|---|---|---|---|---|---|---|
| Ex. 1 | 1 | B | B | A | B | A |
| Ex. 2 | 2 | B | B | A | B | A |
| Ex. 3 | 3 | B | B | A | B | A |
| Ex. 4 | 4 | B | B | A | B | A |
| Ex. 5 | 5 | B | B | A | B | A |
| Comp. Ex. 1 | 6 | B | B | B | D | B |
| Comp. Ex. 2 | 7 | D | D | B | B | C |
| Comp. Ex. 3 | 8 | B | B | C | D | B |

(1) Image Granularity and Sharpness (2) Background Fouling (3-1) Low-temperature Fixability, (3-2) Hot Offset Resistance (4) Thermostable Preservability This document claims priority and contains subject matter related to Japanese Patent Application No. 2007-227332, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner, comprising:

a binder resin;

a colorant;

a release agent; and a layered inorganic mineral, wherein the toner is manufactured by a method comprising:

dissolving or dispersing the binder resin, optionally together with a precursor of the binder resin, the colorant, a dispersion of the release agent, and the layered inorganic mineral, in an organic solvent to prepare a toner constituent liquid; and dispersing the toner constituent liquid in an aqueous medium to prepare an emulsion containing the toner, and wherein a difference in absorbance ratio between the toner heated for 1 minute in an atmosphere of 100° C. and the toner stored in an atmosphere of 23° C. is from 0.1 to 0.2, wherein the absorbance ratio is a ratio of an absorbance specific to the release agent to an absorbance specific to the binder resin, measured by a Fourier transform infrared—total reflectance (FTIR-ATR) method.

2. The toner of claim 1, wherein the absorbance specific to the release agent is at 2850 $cm^{-1}$.

3. The toner of claim 1, wherein the absorbance specific to the binder resin is at 828 $cm^{-1}$.

4. The toner according to claim 1, wherein the toner comprises the release agent in an amount of from 3 to 6% by weight.

5. The toner according to claim 1, wherein the layered inorganic mineral comprises interlayer ions that are partially modified with an organic ion.

6. The toner according to claim 1, wherein the release agent comprises a hydrocarbon wax.

7. The toner according to claim 1, wherein the toner has an average circularity of from 0.93 to 0.97.

8. The toner according to claim 1, wherein the toner has a volume average particle diameter of from 3 to 7 μm.

9. The toner according to claim 1, wherein the toner has an acid value of from 0.5 to 40.0 KOHmg/g.

10. The toner according to claim 1, wherein the toner has a glass transition temperature of from 40 to 70° C.

11. The toner according to claim 1, wherein the release agent in the dispersion has a volume average particle diameter of from 0.18 to 0.32 μm.

12. The toner according to claim 5, wherein the layered inorganic mineral comprising interlayer ions that are partially modified with an organic ion, is present in an amount of from 0.05 to 5.0% by weight.

13. The toner according to claim 6, wherein the hydrocarbon wax is a paraffin wax.

* * * * *